US010731282B2

(12) United States Patent
Klein et al.

(10) Patent No.: US 10,731,282 B2
(45) Date of Patent: Aug. 4, 2020

(54) GRIPPER FOR A TUFTING MACHINE

(71) Applicant: Groz-Beckert KG, Albstadt (DE)

(72) Inventors: Michael Klein, Marl (DE); Andreas Englmeier, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 141 days.

(21) Appl. No.: 15/986,345

(22) Filed: May 22, 2018

(65) Prior Publication Data

US 2018/0334766 A1 Nov. 22, 2018

(30) Foreign Application Priority Data

May 22, 2017 (EP) ..... 17172134

(51) Int. Cl.
*D05C 15/22* (2006.01)

(52) U.S. Cl.
CPC ..... *D05C 15/22* (2013.01); *D05D 2209/12* (2013.01)

(58) Field of Classification Search
CPC ..... D05C 15/22; D05C 15/24; D05C 9/22
See application file for complete search history.

(56) References Cited

U.S. PATENT DOCUMENTS 2,090,021 A * 8/1937 Baynton ..... D03D 39/00 112/80.59
2008/0083359 A1 4/2008 Hillenbrand et al.
2008/0264314 A1 10/2008 Hillenbrand et al.
2009/0107371 A1 4/2009 Hillenbrand et al.
2010/0101470 A1* 4/2010 Hillenbrand ..... D05C 15/22 112/80.5
2012/0024208 A1* 2/2012 Buchle ..... D05C 15/22 112/80.6
2012/0024209 A1 2/2012 Bitzer et al.
2017/0058439 A1* 3/2017 Beach ..... D05C 15/22

FOREIGN PATENT DOCUMENTS

DE 2341567 A1 2/1975
EP 0200810 A1 11/1986
EP 1908871 A1 4/2008
EP 1953290 A1 8/2008
(Continued)

OTHER PUBLICATIONS

European Search Report for corresponding European Application No. 17172134.3, dated Nov. 7, 2017, 6 pages.
(Continued)

*Primary Examiner* — Tajash D Patel
(74) *Attorney, Agent, or Firm* — Fitch, Even, Tabin, & Flannery LLP

(57) ABSTRACT

The invention relates to a gripper for a tufting machine, which has a gripper body and an insert. In the longitudinal direction, the gripper has a holding section and a guiding section. At the end further away from the holding section, in the longitudinal direction, the guiding section terminates in a hook which has an inner side in which a joint gap is arranged between the gripper body and the insert. According to the invention, the gripper is characterised in that a stop means, against which the insert abuts in the longitudinal direction towards the holding section, is arranged on the gripper body in the gripper's guiding section in order to limit the size of the joint gap in the inner side of the hook.

14 Claims, 6 Drawing Sheets

(56) References Cited

FOREIGN PATENT DOCUMENTS

| | | | |
|---|---|---|---|
| EP | 2412856 | A1 | 2/2012 |
| EP | 2412859 | A1 | 2/2012 |
| EP | 2412860 | A1 | 2/2012 |
| FR | 1473511 | A | 3/1967 |

OTHER PUBLICATIONS

European Communication pursuant to Article 94(3) EPC dated Aug. 9, 2019, in corresponding European Patent Application No. 17 172 134.3, with machine English translation (9 pages).

* cited by examiner

GRIPPER FOR A TUFTING MACHINE

RELATED APPLICATION(S)

This application claims the benefit of European Patent Application No. 17172134.3 filed May 22, 2017, the contents of which is incorporated herein by reference as if fully rewritten herein.

BACKGROUND

A large variety of grippers for tufting machines are known. The task of grippers in tufting machines is to pick up the thread from a needle, which transports the thread through a backing material, in order to form a loop. This loop is often cut directly after it has been formed. For this purpose, the gripper acts jointly with a knife that is in contact with the gripper and slides along it. To protect the gripper from excessive wear caused by the knife, an insert made of wear-resistant material is often arranged on the gripper body and, in most cases, is soldered thereto.

Grippers of this kind are shown, for example, in EP 2 412 856 A1, EP 1 953 290 A1, EP 0 200 810A1 and DE 23 41 567 A1.

A gripper of this sort is also shown in EP 2 412 860 A9. To secure the insert in the desired position during production of the gripper (particularly during the soldering process), the gripper is provided, in one embodiment, with a spring element which is arranged in the holding section of the gripper body. The spring element is extremely filigree and is accordingly of limited effectiveness.

What all the above-mentioned grippers have in common is that a sizeable gap may exist between the gripper body and the insert. At a position at which the thread makes contact with this gap, the thread will, with time, wash out the relatively soft solder and will then sustain damage caused by the edges of the gripper body and of the insert. This results in a carpet surface that looks uneven and shaggy on account of the torn filaments. This problem mostly occurs on the inner side of a hook because here, the thread necessarily makes frequent contact with a gap that exists there, since this area serves for picking up the thread from the needle and therefore relative movement necessarily occurs between the thread and the gripper. In some cases, the thread may even jam and then tear.

Based on this prior art, the objective of the present invention is to provide a gripper with which the above-mentioned problems are avoided or are less severe and a consistent product appearance of the carpet is obtained.

SUMMARY

This objective is achieved by a gripper comprising a gripper body and an insert, wherein the gripper has, in its longitudinal direction, a holding section and a guiding section. At the end further away from the holding section, in the longitudinal direction, the guiding section terminates in a hook. The hook has an inner side, in which a joint gap is disposed between the gripper body and the insert. The invention provides for a stop means, against which the insert abuts in the longitudinal direction towards the holding section, to be arranged on the gripper body in the guiding section of the gripper. This gripper-body configuration limits the size of the joint gap in the inner side of the hook. Accordingly, a contact means is arranged on the insert in the guiding section of the gripper and abuts against the gripper body's stop means in the longitudinal direction towards the holding section. During production of the gripper, the gripper body and the insert have to be fitted together and connected with each other. A soldering process may be a preferred method of creating the connection. During soldering, that is, during cooling and hardening of the solder, the position of the insert relative to the gripper body may shift. The gap between the gripper body and the insert may grow in an uncontrolled manner and by a different amount at different places. If the gripper body and the insert are stuck together, a comparable displacement may also occur during hardening of the adhesive bond. Irrespective of any specific manner of connection, the stop means on the gripper body and the contact means on the insert define a longitudinal position of the parts relative to one another, in which the joint gap, in particular in the inner side of the hook, is limited in size. Limiting the size of the joint gap in the inner side of the hook reduces the risk of the thread being damaged by the gripper-body and insert edges bordering the joint gap in the inner side of the hook. According to the invention, the insert abuts—in the longitudinal direction—against the gripper body at three locations; at each of these locations, a joint gap exists between the parts in mutual abutment. At both its ends, the insert is embraced in the longitudinal direction by the gripper body. These two stops act in the longitudinal direction but are oriented differently. The third stop, provided for by this invention, acts in the longitudinal direction and has the same orientation as the stop in the holding portion. On account of its being arranged in the guiding portion, this third stop limits the size of the joint gap in the inner side of the hook.

The longitudinal direction of the gripper is defined by the cutting edge, which, as is known, is formed on the insert in the guiding section. The lateral direction, at right angles to the longitudinal direction, is the direction in which the two largish, flat sides of the narrow gripper are spaced apart. The elevational direction, which is at right angles to the two aforementioned directions, is the direction pointing towards the backing material when the gripper has been installed in the machine. The holding section of the gripper serves for anchoring of the gripper to the tufting machine and forms an end portion of the gripper in the longitudinal direction. Frequently, a plurality of grippers are combined in a module and the holding section is then anchored in what is termed a module block.

The hook prevents the picked-up loops from sliding off the gripper again. Starting from the cutting edge or from an extension of the cutting edge, the hook may extend for this purpose in the elevational direction in such a manner as to increase the gripper's reach in the elevational direction. In other words, the entire guiding portion forms a longish body which, at the end further away from the holding portion, is shaped like a hook. On the hook, an inner side, in particular, is configured with a surface normal oriented approximately in the longitudinal direction towards the holding section. The gripper body and the insert extend into the hook and form a joint gap in the inner side of the hook. It may be advantageous if this joint gap is shifted far towards the outer edge of the hook's inner surface. A loop under tensile stress will then not be in contact with this joint gap so frequently. It is particularly preferable if at least 50% of the inner side of the hook is formed by the insert. However, it is also conceivable for the insert to form 65% or 80% of the inner side.

It is advantageous if the stop means on the gripper body is arranged longitudinally in the guiding section, in the end area thereof which is further away from the holding section. The distance in the longitudinal direction between the stop means and the gripper end distant from the holding section is then small compared to the gripper's overall extension in the longitudinal direction. Variations in the dimensions of the gripper body, which, in the case of customary manufacturing methods, amount to fractions of the gripper body's overall extension, are then correspondingly smaller in this end area. In a preferred embodiment, the insert is embraced in the longitudinal direction at both ends by the gripper body, thus preventing a maximum degree of inaccuracy in the longitudinal positioning from being exceeded. However, the gripper body and the insert are relatively long in the longitudinal direction, meaning that production-related variations in the linear dimensions of both parts are not negligible. On account of the stop means and the contact means being arranged in the end area distant from the holding section, the deviations in this end area are correspondingly smaller. Since the stop means and the contact means have to interact for purposes of exact positioning, the two positioning means, on the gripper body and on the insert, must be arranged such that they coincide accordingly. In the illustrative embodiments according to the invention, the exact positioning of the two parts in the holding section is not all-important.

It is preferable if the distance, in the longitudinal direction, between the stop means and the end of the guiding section nearer to the holding section is at least twice as great as the distance, in the longitudinal direction, between the stop means and the end of the guiding section further away from the gripper's holding section. The distances may also differ, however, by at least a factor of three or at least a factor of four or more.

The stop means is preferably arranged securely on the gripper body and the contact means securely on the insert. Secure is defined in this invention as being immovable and indeformable relative to the part in question. Spring elements, in particular, which are known from the prior art, are not arranged securely in this sense In an advantageous embodiment, the stop means has a stop-surface element with a surface normal pointing, in the longitudinal direction, to the end of the gripper's guiding section that is further away from the holding section. It is also advantageous that the contact means has a contact-surface element that is arranged on the insert and has a surface normal pointing, in the longitudinal direction, towards the holding section. It is furthermore advantageous if the two surface elements are arranged such as to be mutually contiguous. The surface elements with the corresponding orientation may be relatively small or may exist almost only as points on curved surfaces. If there are no correspondingly oriented surface elements, it is possible that the parts are not positioned exactly with respect to each other. According to the invention, surface elements may also exist whose orientation corresponds only approximately. In this publication, "contiguous" may have different meanings. In the one instance, the surface elements may be in direct contact with each other in order to guarantee exact positioning. In the other instance, the invention also provides for a bonding agent (such as solder, adhesive or the like) to be disposed between the the gripper body and the insert. This intermediate layer may be taken into account and included in the planning of the relative positions of the stop means and the contact means. Similarly, there may be an adhesive between the stop means and the contact means when the insert is described as abutting on the gripper body.

The stop means may be formed by a projection on the gripper body or on the insert. The contact means may then be formed as a depression, which matches the stop means, in the insert or gripper body. In a preferred illustrative embodiment, the stop means is a projection on the gripper body and the contact means is a matching depression in the insert. Surface elements of the depression are then in contact—with or without an intermediate layer of bonding agent—with surface elements of the projection, thereby precisely setting the positions of the parts relative to one another. The projection may be configured integrally with the gripper body or the insert and thus consist, in particular, of the same material. The projection may be formed by an additional part, which is secured to either the gripper body or the insert.

In an advantageous embodiment, the gripper body and the insert do not overlap in a lateral direction. In particular, both parts then have the same width. However, this does not rule out the possibility of reducing the width in sections of the gripper body or the insert, or both. At the gripper end distant from the holding section, for example, reductions in the width of the gripper body and/or of the insert may exist in order to make room, for example, for the tufting needle or for sharpening the gripper in order to facilitate picking up of the loops. Other features relating to the shape of grippers are known, which adapt the width of the gripper body and/or the insert and which are all explicitly compatible with the present invention. Similarly, it is possible for the gripper end distant from the holding section to be rounded off in different directions. In so far, the flat sides of the gripper are not necessarily planar over the entire surface. However, the scope of the invention includes embodiments in which, for example, the insert is accommodated in a pocket of the gripper body and is thus, at least section-wise, narrower than the gripper body at its widest point.

A bonding agent, in particular a solder, is preferably disposed between the gripper body and the insert. However, any other bonding agent, for example adhesives, can be used in this invention. It is furthermore preferable if the bonding agent exists at each point at which the gripper body and the insert are contiguous. It is also possible, however, for there to be no bonding agent in various contiguous areas, for example in the area of the stop and contact means, and for the parts to be in direct mutual contact.

The insert may comprise hard metal or consist entirely of hard metal or another particularly wear-resistant material. The gripper body preferably comprises a tool steel of consists entirely thereof. All materials suitable for the application in question are conceivable for the gripper body and the insert. The fundamental idea does not impose any limitations concerning the choice of material, provided that stop means and/or contact means can be moulded on the gripper body and insert, and these can be joined with a bonding agent.

DETAILED DESCRIPTION

Figure 1:
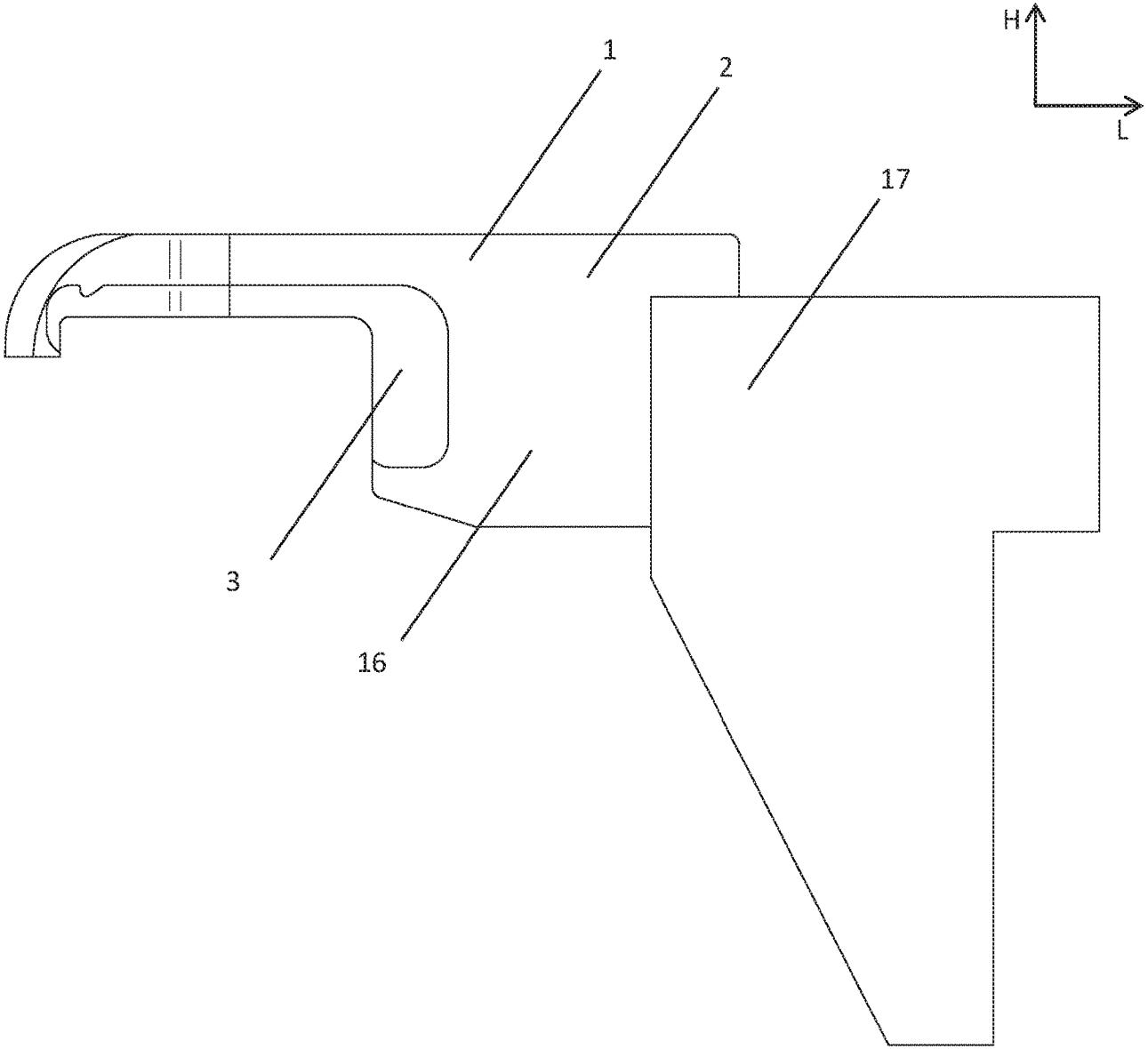
FIG. 1 shows a view of a flat side of a gripper according to the invention, with the gripper held in a gripper block.

FIG. 1 shows a view of a flat side 16 of a gripper 1 according to the invention, with the gripper 1 held in a gripper block 17. To simplify matters, details have been largely omitted in all of the drawings. For example, the joint gap between the gripper body 2 and the insert 3 is never shown as having a width but just as a simple line at the site of the joint. The longitudinal and elevational directions are also indicated. The same orientation applies to all the following drawings. Further grippers 1 that are obscured by the gripper 1 shown may be secured to the gripper block 17. In so far, FIG. 1 only serves to provide a general overview.

Figure 2:
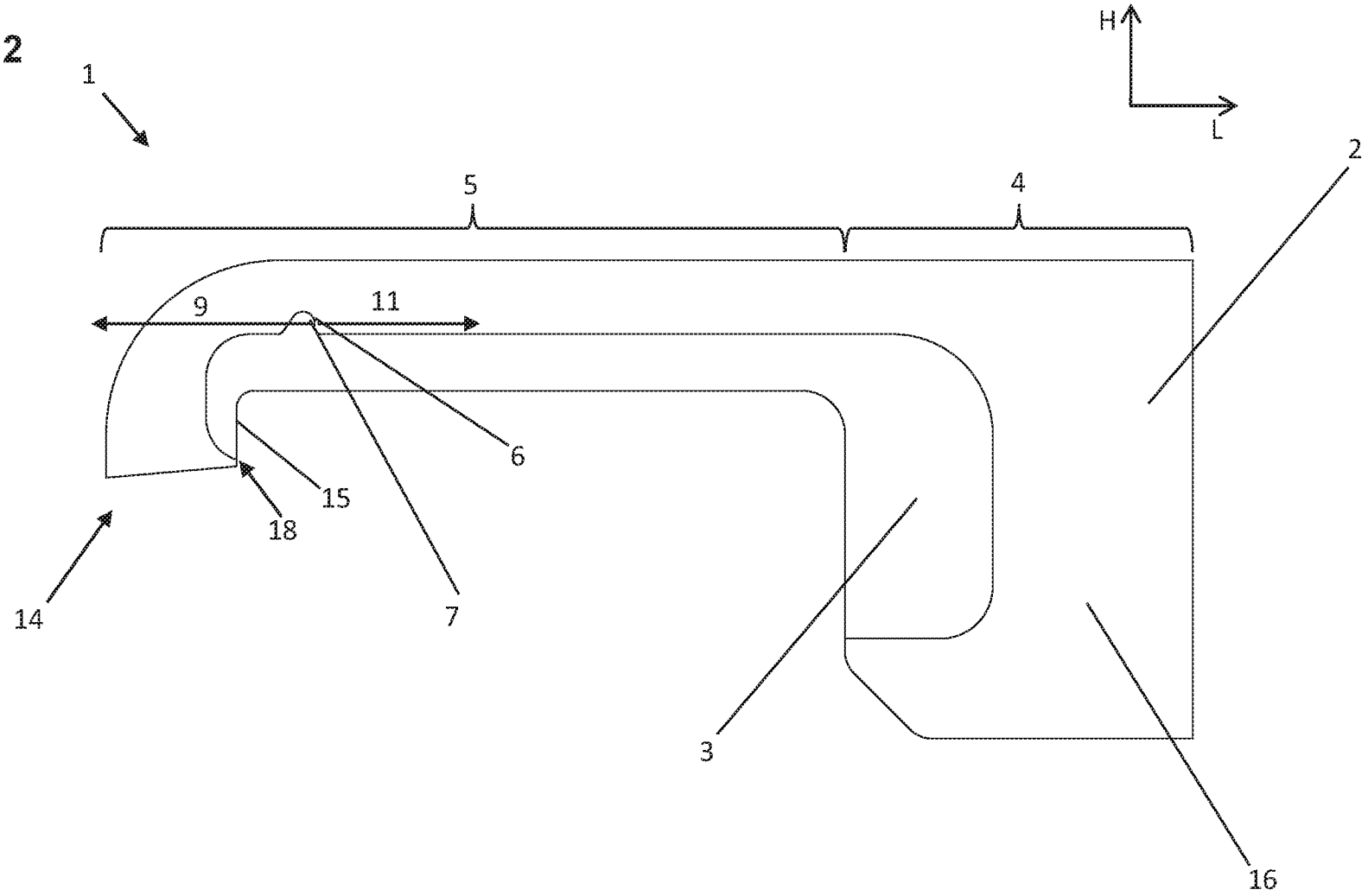
FIG. 2 shows a view of a flat side of another gripper according to the invention.

FIG. 2 shows another gripper 1 according to the invention, again looking at a flat side 16. For purposes of clarification, the holding portion 4 and the guiding portion 5 are indicated with curly brackets. Both the gripper body 2 and the insert 3 extend into the holding portion 4 and into the guiding portion 5, including into the hook 14. The hook forms, inter alia, an inner side 15 which is oriented towards the holding portion 4. In this embodiment, the insert 3 forms a contact means 7, which projects from the insert 3 and interacts with a stop means 6 configured as a depression in the gripper body 2. The stop means 6 in the gripper body 2 has a surface normal 9, which is shown as an arrow starting from said stop means 6.

The surface normal 11 of the contact means 7 on the insert 3 is also shown as an arrow, starting from said contact means 7. On the inner side 15 of the hook 14, the gripper body 2 and the insert 3 form a joint 18, which, however, is again depicted only as a simple line.

Figure 3:
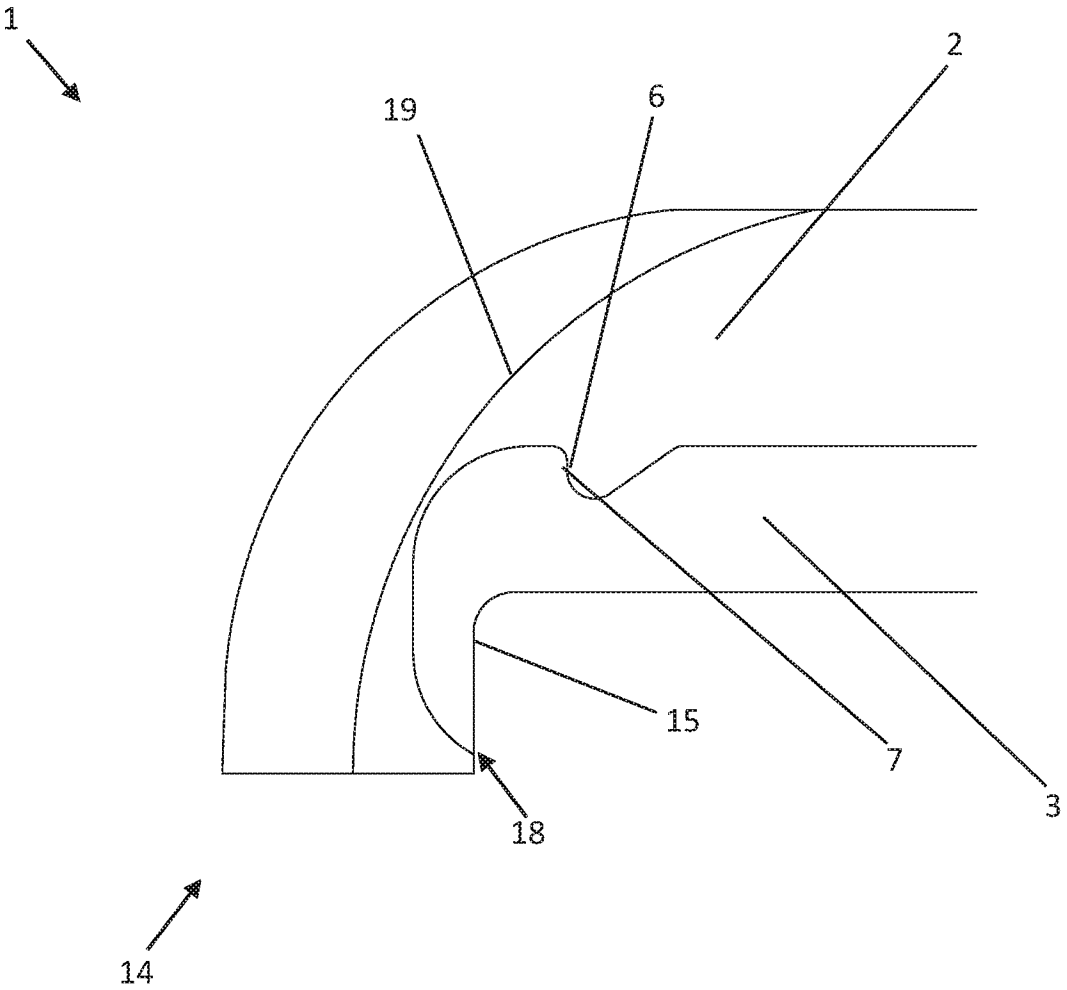
FIG. 3 shows an enlarged view of the end portion of the gripper shown in FIG. 1.

FIG. 3 shows an enlarged view of the end portion of the gripper 1 shown in FIG. 1. The end of the gripper 1 is pointed, this being visualised by the ground edge 19 on the gripper body 2. The insert 3 forms the major part of the inner side 15 of the hook 14. On the gripper body 2, a stop means 6 is configured, which projects out from the gripper body 2. A matching contact means 7 is configured on the insert 3 and abuts on the stop means 6 on the gripper body. Here too, the joint gap 18 between the gripper body 2 and the insert 3 is just shown as a simple line, although a readily recognizable gap may exist between the parts.

Figure 4A:
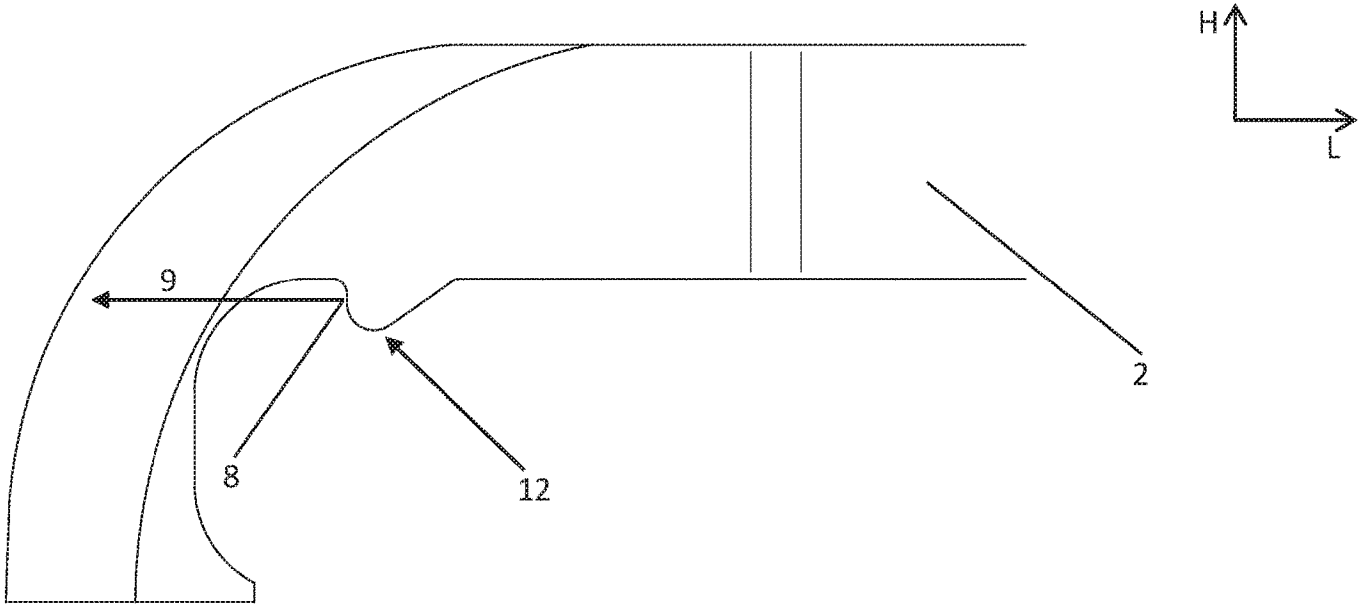
FIG. 4*a* shows the gripper body of FIG. 3.
Figure 4B:
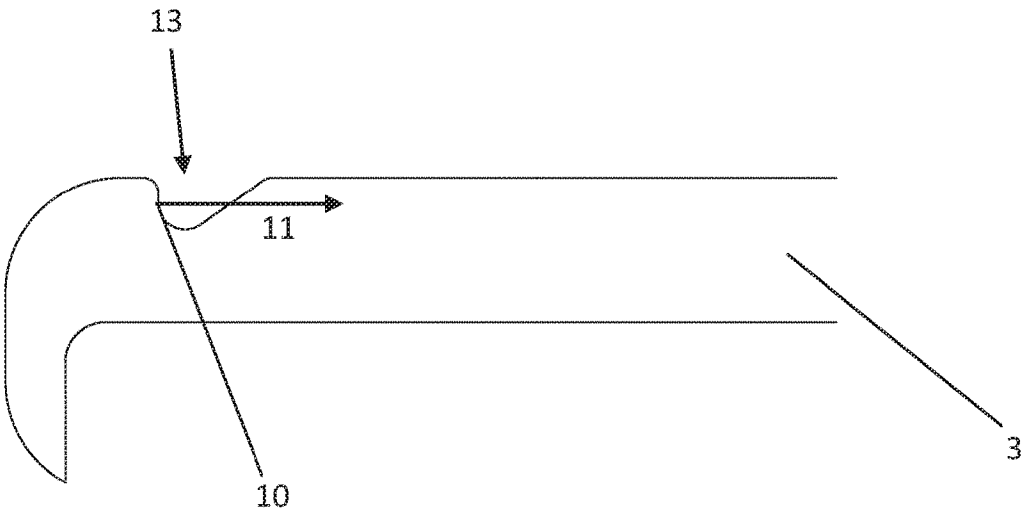
FIG. 4*b* shows the insert of FIG. 3.

FIG. 4*a* shows the gripper body 2 of FIG. 3. FIG. 4*b* shows the insert 3 of FIG. 3. The two parts are precisely aligned with each other in the longitudinal direction, although, for purposes of easier comprehension, the insert has been displaced downwards in the opposite elevational direction H. The gripper body has a projection 12, which has a stop-surface portion 8 with a surface normal 9 shown as an arrow. The insert 3 has a depression 13. A contact-surface element 10 with a surface normal 11 shown as an arrow lies in the depression 13.

Figure 5:
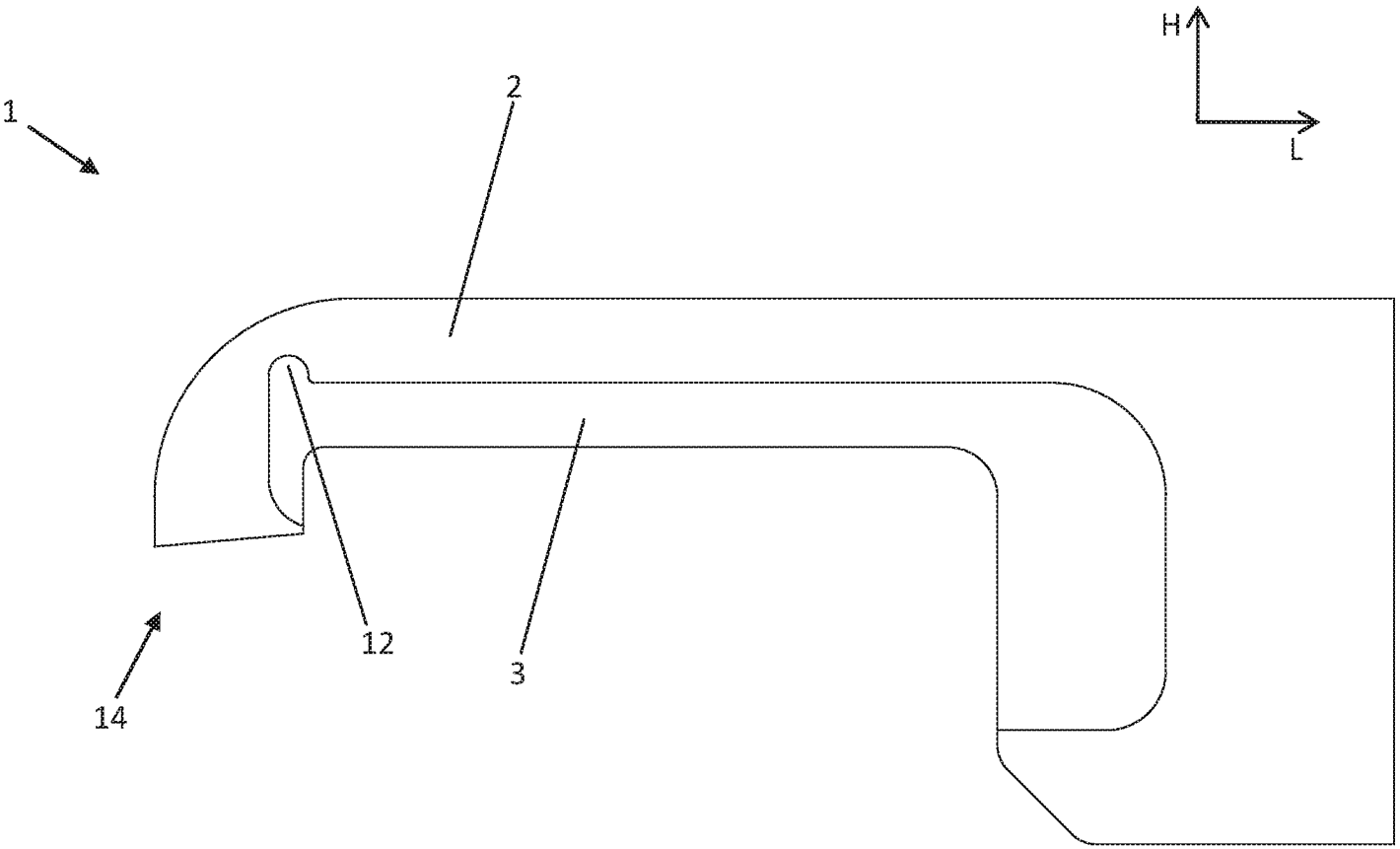
FIG. 5 shows a further gripper according to the invention.

FIG. 5 shows a further gripper 1 according to the invention. Differing from the preceding illustrative embodiments, the insert 3 has a projection 12 which is located at the very end of the insert 3 as seen in the longitudinal direction.

Figure 6:
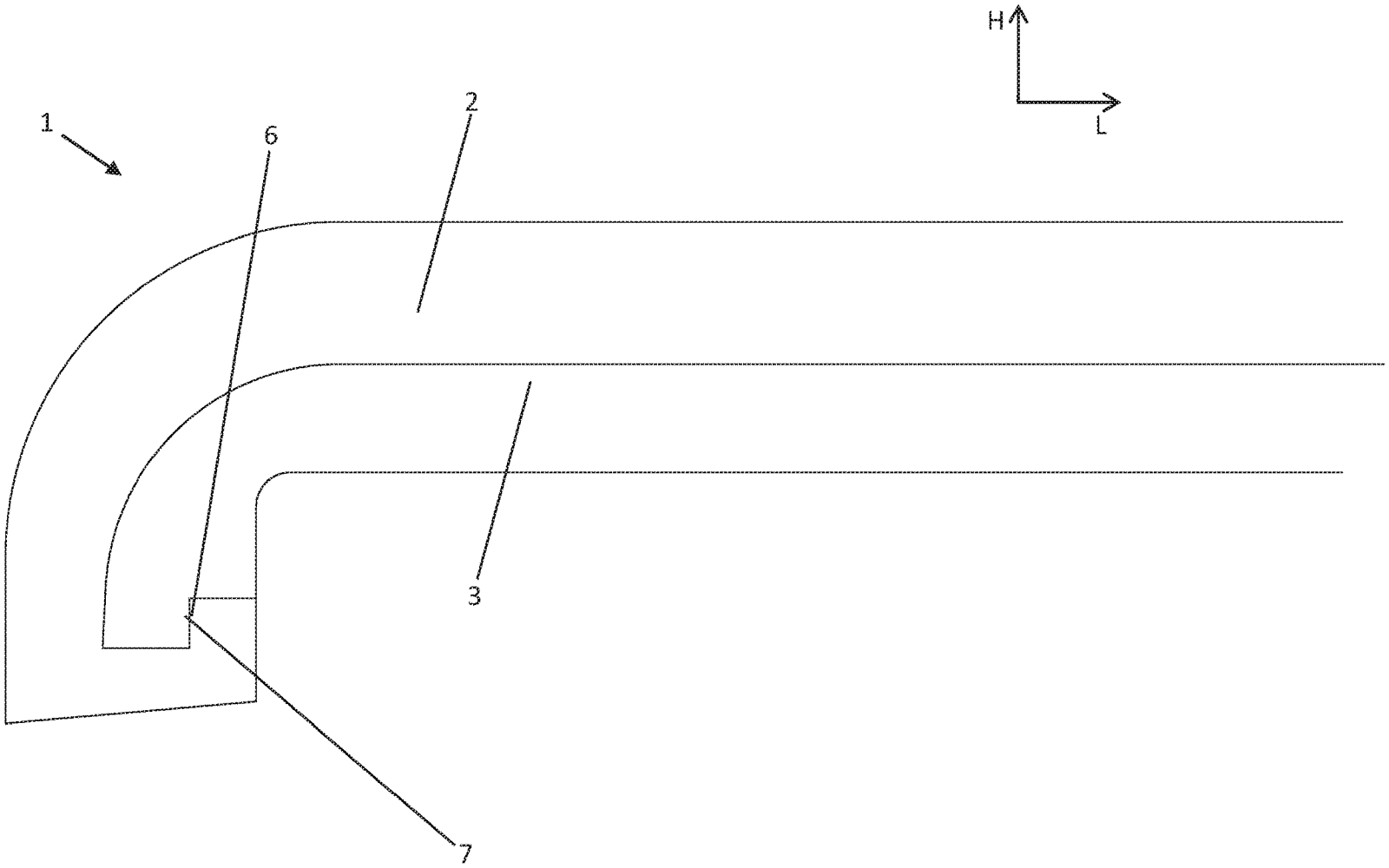
FIG. 6 shows a further gripper according to the invention.

FIG. 6 shows a further gripper 1 according to the invention. In this illustrative example, the contact means 7 on the insert 3 is again provided at the end of the insert as seen in the longitudinal direction L, but in this example on the bottom portion of the insert 3 as seen in the elevational direction H. A matching stop means 6 is configured on the gripper body 2.

| List of reference numerals | |
|---|---|
| 1 | Gripper |
| 2 | Gripper body |
| 3 | Insert |
| 4 | Holding section |

-continued

| List of reference numerals | |
|---|---|
| 5 | Guiding section |
| 6 | Stop means |
| 7 | Contact means |
| 8 | Stop-surface element |
| 9 | Surface normal to the stop-surface element |
| 10 | Contact-surface element |
| 11 | Surface normal to the contact-surface element |
| 12 | Projection |
| 13 | Depression |
| 14 | Hook |
| 15 | Inner side of hook |
| 16 | Flat side |
| 17 | Gripper block |
| 18 | Joint gap |
| 19 | Ground edge |
| B | Lateral direction |
| H | Elevational direction |
| L | Longitudinal direction |

What is claimed is:

1. Gripper (1) for a tufting machine, comprising a gripper body (2) and an insert (3), wherein the gripper (1) has, in a longitudinal direction (L), a holding section (4) and a guiding section (5), wherein, at an end further away from the holding section (4), in the longitudinal direction (L), the guiding section (5) terminates in a hook (14), wherein said hook has an inner side (15), in which a joint gap (18) is arranged between the gripper body (2) and the insert (3), wherein a stop means (6), against which the insert (3) abuts in the longitudinal direction (L) towards the holding section (4), is arranged on the gripper body (2) in the guiding section (5) of the gripper (1) in order to limit a size of the joint gap (18) in the inner side (15) of the hook (14).

2. Gripper (1) according to claim 1, wherein a contact means (7), which abuts against the gripper body's stop means (6) in the longitudinal direction (L) towards the holding section (4), is arranged on the insert (3) in the guiding section (5) of the gripper.

3. Gripper (1) according to claim 2, wherein at least 50% of an inner side (15), facing towards the holding section (4), of the hook (14) is formed by the insert (3).

4. Gripper (1) according to claim 1, wherein the stop means (6) on the gripper body (2) is arranged longitudinally in the guiding section (5), in the end area thereof which is further away from the holding section (4).

5. Gripper (1) according to claim 1, wherein a distance, in the longitudinal direction (L), between the stop means (6) and an end of the guiding section (5) nearer to the holding section (4) is at least twice as great as a distance, in the longitudinal direction, between the stop means (6) and an end of the guiding section (5) of the gripper (1) which is further away from the holding section (4).

6. Gripper (1) according to claim 1, wherein the stop means (6) is arranged securely on the gripper body (2) and the contact means (7) securely on the insert (3).

7. Gripper (1) according to claim 1, wherein the stop means (6) has a stop-surface element (8) with a surface normal (9) pointing, in the longitudinal direction (L), towards an end of the guiding section (5) of the gripper (1) which is further away from the holding section, and the contact means (7) has, arranged on the insert (6), a contact-surface element (10) with a surface normal (11) pointing, in the longitudinal direction (L), towards the holding section (2), and that the stop-surface element (8) and the contact-surface element (10) are arranged such as to be mutually contiguous.

8. Gripper (1) according to claim 1, wherein the stop means (6) is formed by a projection (12) on the gripper body (2) or the insert (3), and the contact means (7) is formed by a depression (13) in the insert (3) or the gripper body (2).

9. Gripper (1) according to claim 8, wherein the projection (12) is formed integrally with the gripper body (2) or the insert (3).

10. Gripper (1) according to claim 8, wherein the projection (12) is formed by an additional part.

11. Gripper according to claim 1, wherein the gripper body (2) and the insert (3) do not overlap in a lateral direction (B).

12. Gripper (1) according to claim 1, wherein a bonding agent is disposed between the gripper body (2) and the insert (3).

13. Gripper (1) according to claim 1, wherein the insert (3) comprises hard metal.

14. Gripper (1) according to claim 1, wherein the gripper body (2) comprises a tool steel.

* * * * *